US008378936B2

(12) United States Patent
Koh et al.

(10) Patent No.: US 8,378,936 B2
(45) Date of Patent: Feb. 19, 2013

(54) DISPLAY APPARATUS AND METHOD OF DRIVING THE SAME

(75) Inventors: Byung-Sik Koh, Gwangmyeong-si (KR); Si-Duk Sung, Seoul (KR); Kwang-Sub Shin, Anyang-si (KR); Jong-Hwa Park, Seoul (KR)

(73) Assignee: Samsung Display Co., Ltd. (KR)

( * ) Notice: Subject to any disclaimer, the term of this patent is extended or adjusted under 35 U.S.C. 154(b) by 1009 days.

(21) Appl. No.: 12/405,796

(22) Filed: Mar. 17, 2009

(65) Prior Publication Data

US 2010/0060554 A1 Mar. 11, 2010

(30) Foreign Application Priority Data

Sep. 11, 2008 (KR) ..... 10-2008-0089979

(51) Int. Cl.
*G09G 3/30* (2006.01)

(52) U.S. Cl. ..... 345/77; 345/76

(58) Field of Classification Search ..... 345/76, 345/77, 89, 690; 315/169.1–169.4
See application file for complete search history.

(56) References Cited

U.S. PATENT DOCUMENTS

2005/0057581 A1* 3/2005 Horiuchi et al. ..... 345/690
2005/0110810 A1* 5/2005 Lee et al. ..... 345/690
2005/0212825 A1* 9/2005 Lee et al. ..... 345/690
2006/0284802 A1 12/2006 Kohno

FOREIGN PATENT DOCUMENTS

JP 2006-267430 10/2006
KR 1020060062645 A 6/2006
KR 1020070014698 A 2/2007

* cited by examiner

*Primary Examiner* — Kevin M Nguyen
*Assistant Examiner* — Sepideh Ghafari
(74) *Attorney, Agent, or Firm* — Innovation Counsel LLP

(57) ABSTRACT

In a display apparatus and a driving method thereof, image data corresponding to plural different positions of a display panel are added to each other, and a sum of the image data of a present frame is compared with a sum of the image data of a previous frame to determine whether an image displayed on the display panel is a still image or not. While a still image is displayed, brightness of the display panel is gradually lowered. Accordingly, the display panel may prevent occurrence of afterimages and deterioration of organic electroluminescent light emitting devices, as well as reduce power consumption.

12 Claims, 7 Drawing Sheets

DISPLAY APPARATUS AND METHOD OF DRIVING THE SAME

CROSS-REFERENCE TO RELATED APPLICATION

This application claims priority to Korean Patent Application No. 2008-89979 filed on Sep. 11, 2008, the contents of which are herein incorporated by reference in its entirety.

BACKGROUND

1. Field of the Invention

The present invention relates to electronic displays. More particularly, the present invention relates to an organic electroluminescent light emitting display device and a method of driving the organic electroluminescent light emitting display device.

2. Description of the Related Art

In recent years, lightweight, slim display devices have been desirable for use as televisions, monitors, and the like, and organic electroluminescent light emitting display devices are spotlighted as one such desired display device.

In general, an organic electroluminescent light emitting display device displays images using light-emitting properties of an organic electroluminescent light emitting substance. In other words, the organic electroluminescent light emitting device includes an anode, a cathode, and a light emitting material injected between the anode and the cathode. When current is supplied between the anode and the cathode, electrons and holes are injected into the light emitting material, where electron-hole pairs are combined, thereby emitting light and displaying colors.

However, due to their driving schemes, many current organic electroluminescent light emitting display devices display afterimages, which deteriorate image display quality. It is therefore desirable to develop organic electroluminescent light emitting display devices that reduce the occurrence of afterimages.

SUMMARY

Therefore, an exemplary embodiment of the present invention provides a display apparatus capable of reducing afterimages and power consumption, and improving lifespan.

The present invention also provides a method of driving the display apparatus.

In an exemplary embodiment of the present invention, a display apparatus comprises a display panel that displays an image, and a timing controller that processes image data. The timing controller comprises a panel controller that outputs the image data in synchronization with a first control signal, as well as a brightness controller. The brightness controller detects a variation of the image according to a sum of portions of the image data corresponding to predetermined plural positions of the display panel, and outputs a second control signal to control a brightness of the display panel. The display apparatus also includes a panel driver that drives the display panel in response to the first control signal and the image data, and controls a brightness of the display panel in response to the second control signal.

In another exemplary embodiment of the present invention, a method of driving a display apparatus comprises adding image data corresponding to predetermined plural positions of the display panel for a plurality of frames, so as to determine sums of the image data for each frame of the plurality of frames. The method also includes comparing a sum of the image data obtained from a previous frame with a sum of the image data obtained from a present frame to calculate a difference value between the previous frame and the present frame. The difference value is compared with a predetermined reference value. A count value is increased when the difference value is equal to or less than the reference value, and the count value is reset when the difference value is greater than the reference value. The count value corresponds to a displaying time of an image displayed on a display panel. A control signal is generated based on brightness data corresponding to the count value, whereupon a brightness of the display panel is controlled based on the control signal.

BRIEF DESCRIPTION OF THE DRAWINGS

The above and other advantages of the present invention will become readily apparent by reference to the following detailed description when considered in conjunction with the accompanying drawings wherein.

DESCRIPTION OF THE EMBODIMENTS

Hereinafter, the present invention will be explained in detail with reference to the accompanying drawings.

Figure 1:
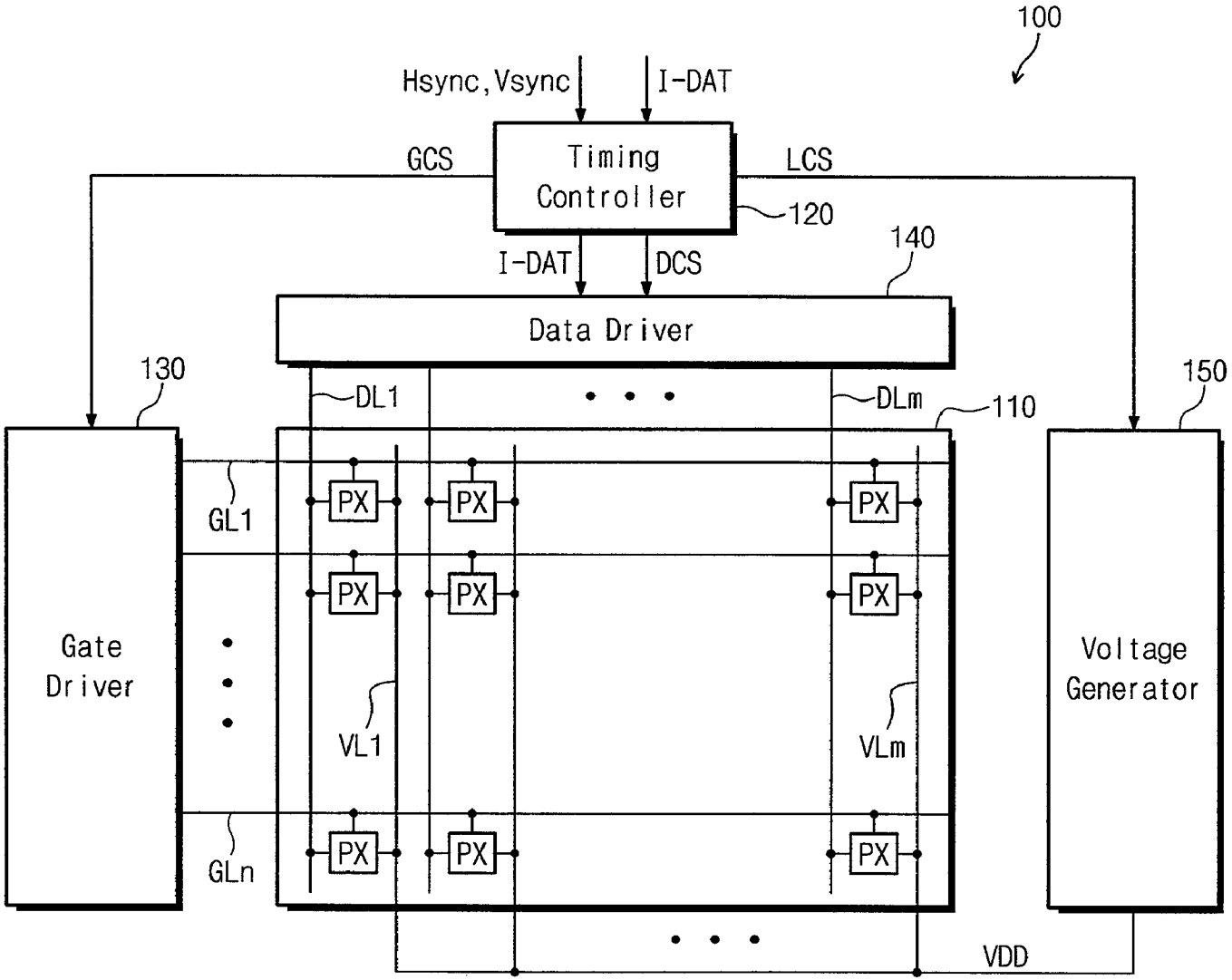
FIG. 1 is a block diagram showing an exemplary embodiment of an organic electroluminescent light emitting display device according to the present invention.
Figure 2:
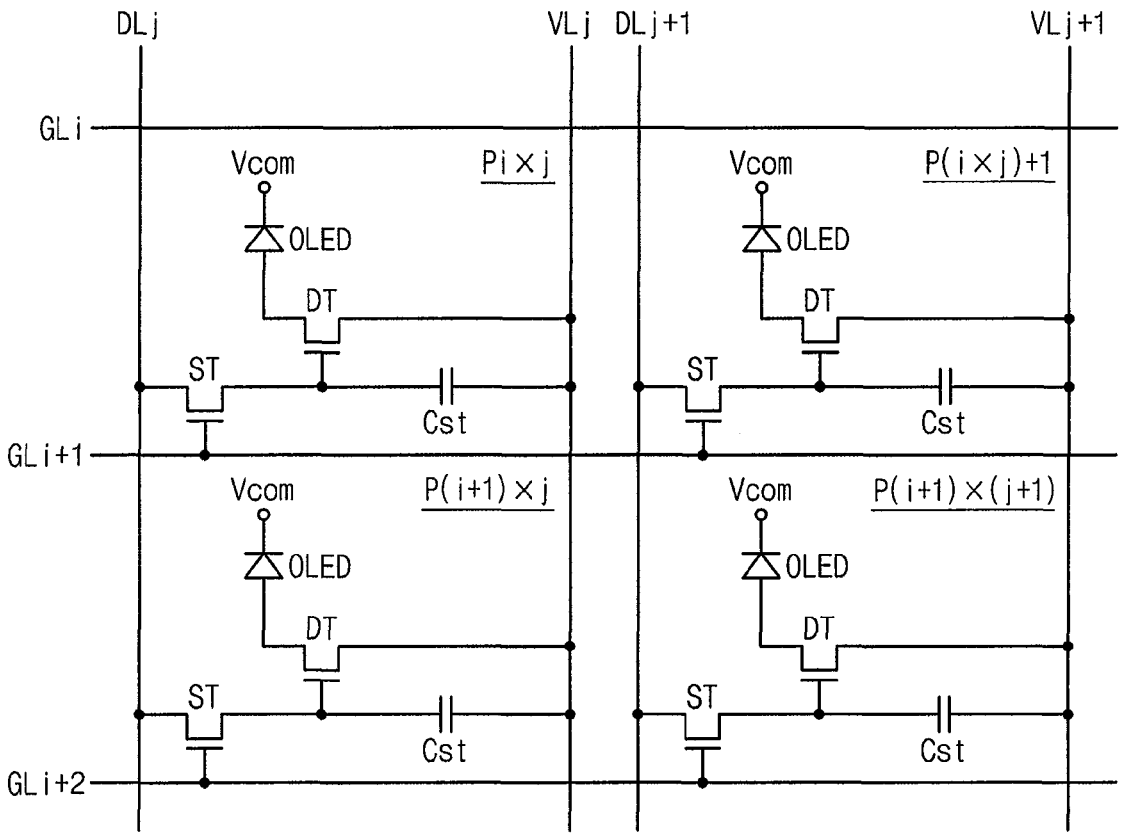
FIG. 2 is an equivalent circuit diagram of pixels in a display panel of FIG. 1.

FIG. 1 is a block diagram showing an exemplary embodiment of an organic electroluminescent light emitting display device according to the present invention. FIG. 2 is an equivalent circuit diagram of pixels in the display panel of FIG. 1. In FIG. 2, only four pixels of the pixels arranged on the display panel have been shown.

Referring to FIG. 1, an organic electroluminescent light emitting display device 100 includes a display panel 110, a timing controller 120, a gate driver 130, a data driver 140, and a voltage generator 150.

The display panel 110 includes a plurality of gate lines GL1~GLn, a plurality of data lines DL1~DLm, and a plurality of voltage lines VL1~VLm. The gate lines GL1~GLn extend in a first direction and are arranged in parallel with each other along a second direction perpendicular to the first direction. The data lines DL1~DLm extend in the second direction and are arranged in parallel with each other along the first direction. The data lines DL1~DLm are insulated from the gate lines GL1~GLn while crossing the gate lines GL1~GLn. The voltage lines VL1~VLm extend in the second direction and are arranged in parallel with each other along the first direction. The voltage lines VL1~VLm are insulated from the gate lines GL1~GLn while crossing the gate lines GL1~GLn. The voltage lines VL1~VLm are electrically connected to each other and electrically insulated from the data lines DL1~DLm.

The display panel 110 includes a plurality of pixel areas defined by the gate lines GL1~GLn, the data lines DL1~DLm, and the voltage lines VL1~VLm in a matrix form. Each pixel area includes a pixel PX arranged therein.

As shown in FIG. 2, each pixel PX includes a switching device ST, a driving transistor DT, an image maintaining capacitor Cst, and an organic electroluminescent light emitting device OLED. Hereinafter, an (i×j)th pixel will be described as an example.

The switching transistor ST includes an input electrode connected to j-th data line DLj, a control electrode connected to i-th gate line GLi, and an output electrode connected to the driving transistor DT. Accordingly, when the switching transistor ST is turned on in response to a gate voltage applied to the i-th gate line GLi, a data voltage applied to the j-th data line DLj is supplied to the driving transistor DT through the output electrode.

The driving transistor DT includes a control electrode connected to the output electrode of the switching transistor ST, an input electrode connected to the j-th voltage line VLj, and an output electrode connected to the organic electroluminescent light emitting device OLED. The j-th voltage line VLj receives a driving voltage VDD. When the driving transistor DT is a p-type transistor, driving voltage VDD has a voltage level higher than that of a common voltage Vcom connected to the organic electroluminescent light emitting device OLED. When the driving transistor DT is n-type, driving voltage VDD has a voltage level lower than that of the common voltage Vcom. Thus, an output current flowing through the output electrode of the driving transistor DT is controlled by the data voltage from the switching transistor ST and the driving voltage VDD from the j-th voltage line VLj.

The image maintaining capacitor Cst is connected between the output electrode of the switching transistor ST and the j-th voltage line VLj, and stores electric charge according to the data voltage output from the output electrode and the driving voltage VDD. The image maintaining capacitor Cst stores charge after the switching transistor ST is turned off, thereby maintaining the driving transistor DT in the turn-on state for a predetermined time interval.

The organic electroluminescent light emitting device OLED may include a diode, of which an anode connects to the output electrode of the driving transistor DT and a cathode receives the common voltage Vcom. An organic light emitting layer (not shown) is interposed between the anode and the cathode. The organic light emitting layer may include a red, green or blue organic material. The color of the organic material for the organic light emitting layer may vary according to the pixel.

When the driving transistor DT is turned on (by the data voltage from data line DLj or by the electric charges stored in the image maintaining capacitor Cst), the output current from the output electrode of the driving transistor DT is supplied to the anode of the organic electroluminescent light emitting device OLED. Accordingly, the magnitude of the output current can be varied so as to vary the intensity of light emitted from the organic electroluminescent light emitting device OLED. In this manner, images having desired gray-scale can be displayed.

Referring to again FIG. 1, the timing controller 120 receives synchronization signals and image data I-DAT from an external source. The image data I-DAT are input to the timing controller 120 frame by frame. The timing controller 120 outputs a gate control signal GCS and a data control signal DCS to control the gate and data drivers 130 and 140, and outputs the image data I-DAT to the data driver 140 in synchronization with the data control signal DCS. In the present exemplary embodiment, the gate control signal GCS includes a vertical start signal and a vertical clock signal, and the data control signal DCS includes a horizontal start signal and a horizontal clock signal.

The gate driver 130 sequentially outputs a gate voltage to the gate lines GL1~GLn in response to the gate control signal GCS, and the data driver 140 outputs the data voltage to the data lines DL1~DLm in synchronization with the data control signal DCS after converting the image data I-DAT into the data voltages. The voltage generator 150 applies the driving voltage VDD to the voltage lines VL1~VLm arranged on the display panel 110.

Meanwhile, in order to control the brightness of the images displayed on the display panel 110, the timing controller 120 outputs a brightness control signal LCS to the voltage generator 150. The LCS can be determined according to a sum of gray scale values of image data (hereinafter, referred to local image data) corresponding to selected positions of the display panel 110 among the image data I-DAT corresponding to one frame.

The voltage generator 150 receives the brightness control signal LCS from the timing controller 120 to adjust the voltage level of the driving voltage VDD. In detail, if a difference between sums of the gray scale values of the local image data, which are respectively obtained from two frames adjacent to each other, is equal to or less than a predetermined reference value, the timing controller 120 provides the brightness control signal LCS to the voltage generator 150. Thus, the voltage generator 150 lowers the voltage level of the driving voltage VDD in response to the brightness control signal LCS by a predetermined voltage level, which is applied to the display panel 110.

As described above, when the driving voltage VDD is lowered, the output current of the driving transistor DT, and thus the intensity of light emitted from the organic electroluminescent light emitting device OLED, is reduced. Accordingly, in cases where still images are displayed, the brightness of the still images is reduced, reducing the intensity of after-images.

Figure 3:
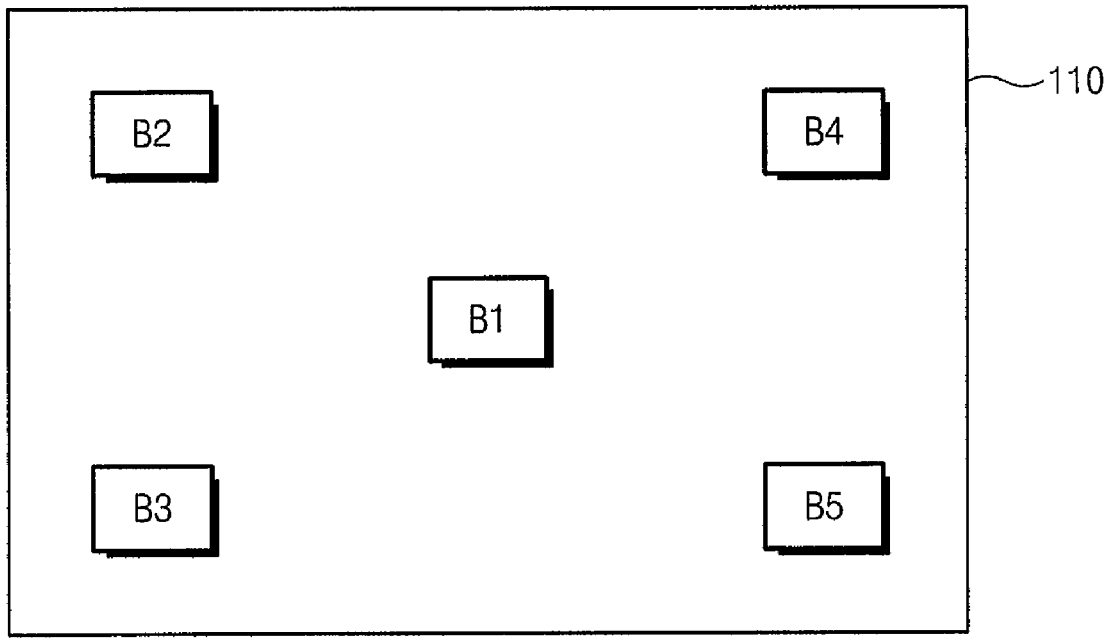
FIG. 3 is a plan view showing a display panel of FIG. 1.

A brightness control function of timing controller 120 will now be described with reference to FIGS. 3 and 4. FIG. 3 is a plan view showing a display panel of FIG. 1, and FIG. 4 is a block diagram showing a timing controller of FIG. 1.

Referring to FIG. 3, the display panel 110 includes first, second, third, fourth and fifth blocks B1, B2, B3, B4 and B5, each of which has a plurality of pixels. As an example, the first to fifth blocks B1~B5 are positioned at a center portion, a left upper portion, a left lower portion, a right upper portion, and a right lower portion, respectively.

In addition, each of the first to fifth blocks B1~B5 may include 20×20 pixels. The number of the blocks and the number of the pixels in each block are exemplary and the invention is not limited thereto. Those of ordinary skill in the art will observe that these numbers can vary according to a number of factors, such as the size of the display panel 110 and the capacity of the timing controller 120.

Figure 4:
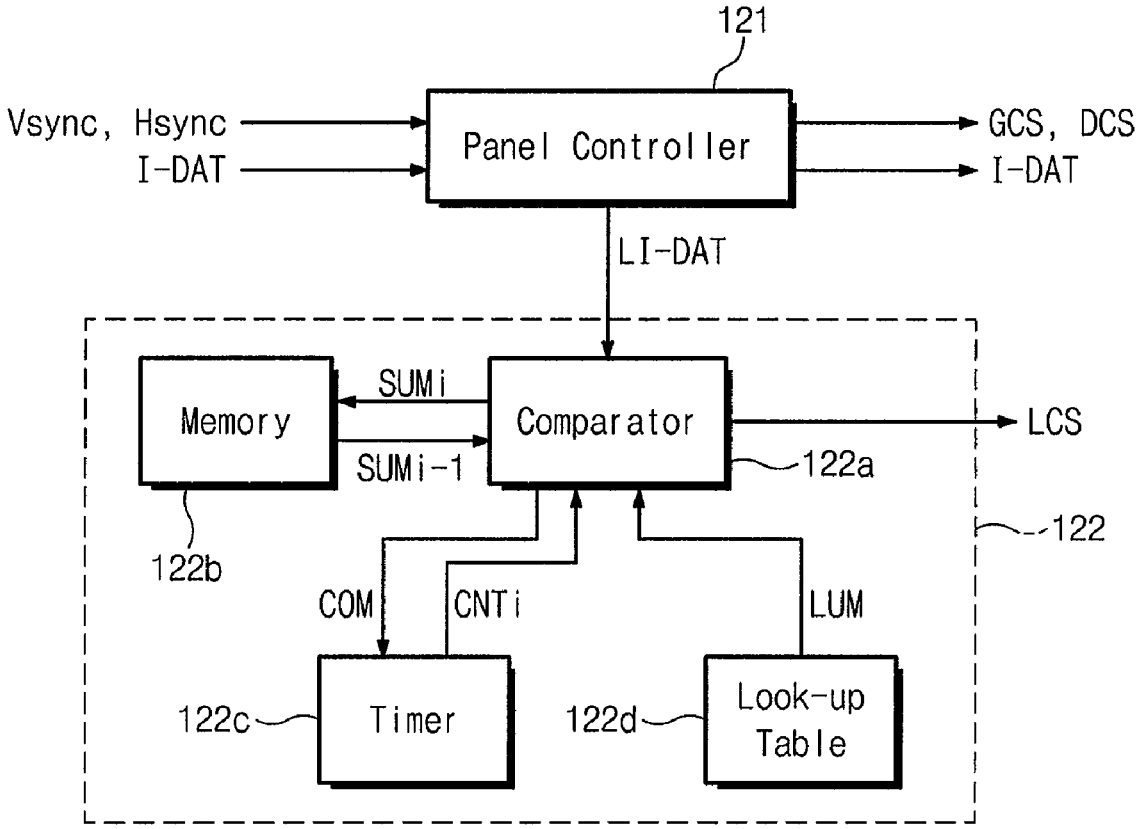
FIG. 4 is a block diagram showing a timing controller of FIG. 1.

As shown in FIG. 4, the timing controller 120 includes a panel controller 121 and a brightness controller 122.

The panel controller 121 receives synchronization signals and image data I-DAT from an exterior and outputs the gate control signal GCS, the data control signal DCS and the image data I-DAT. Also, the panel controller 121 outputs the local image data LI-DAT to the brightness controller 122.

The brightness controller 122 includes a comparator 122*a*, a memory 122*b*, a timer 122*c*, and a look-up table 122*d* in order to control the brightness of the display panel 110. As above, the brightness controller 122 can control the brightness of the display panel 110 according to the sum of the gray scale values of the local image data LI-DAT supplied to each of the first to fifth blocks B1~B2.

The comparator 122*a* compares sums of the gray scale values of the local image data corresponding to the positions, which are respectively obtained from two frames adjacent to each other, to output a comparison signal. The comparator 122*a* calculates the sum SUMi of the gray scale values of the local image data LI-DAT corresponding to the first to fifth blocks B1~B5 of the panel controller 121 during a present frame and stores the sum SUMi of the local image data LI-DAT into the memory 122*b*. Also, the comparator 122*a* reads out the sum SUMi-1 of the gray scale values of the local image data LI-DAT corresponding to a previous frame from the memory 122*b*. Thus, the comparator 122*a* compares the sum SUMi of the present frame with the sum SUMi-1 of the previous frame. When the difference between the two sums SUMi and SUMi-1 is equal to or less than the predetermined reference value, the comparator 122*a* outputs a comparison signal COM corresponding to a first state, and when the difference between the two sums SUMi and SUMi-1 is greater than the reference value, the comparator 122*a* outputs a comparison signal COM corresponding to a second state.

The comparison signal COM is provided to the timer 122*c*. The timer 122*c* adds "1" to a previous count value (not shown) when the comparison signal COM has the first state, and the sum becomes present count value CNTi. The present count value CNTi is provided to the comparator 122*a*. The timer 122*c* resets the previous count value when the comparison signal COM has the second state.

The comparator 122*a* reads out brightness data from the look-up table 122*d* based on the present count value CNTi and the sum SUMi of the present frame. Particularly, the look-up table 122*d* stores various brightness data using the present count value CNTi and the sum SUMi of the present frame as its variables.

The comparator 122*a* outputs the brightness control signal LCS based on the read-out brightness data LUM to control the voltage generator 150 (shown in FIG. 1). Accordingly, the voltage generator 150 controls the voltage level of the driving voltage VDD in response to the brightness control signal LCS, so that the brightness of the display panel 110 may be adjusted. Consequently, if the same image (e.g., still image) is displayed on the display panel 110 during a predetermined time interval, the brightness of the display panel 110 is lowered, thereby preventing occurrence of afterimages, deterioration of the organic electroluminescent light emitting device OLED, and reducing power consumption.

In addition, since the timing controller 120 uses the image data corresponding to each block B1~B5, the timing controller 120 may perform its operation using the memory 122*b* installed therein. Thus, no additional memory is required, so that the number of the parts for the display apparatus 100 may be reduced.

Figure 5:
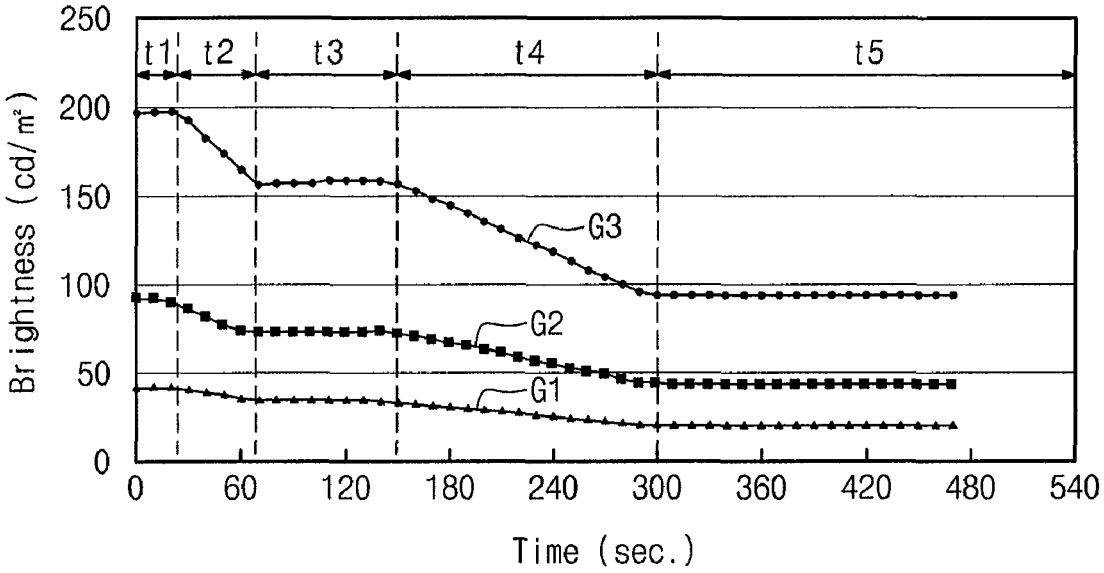
FIG. 5 is a graph showing brightness variations according to elapsed time.

FIG. 5 is a graph showing brightness variations according to elapsed time. In FIG. 5, a first graph G1 represents brightness over time when the brightness of an initial still image is 40 cd/m$^2$, a second graph G2 represents brightness over time when the brightness of an initial still image is 90 cd/m$^2$, and a third graph G3 represents brightness over time when the brightness of an initial still image is 190 cd/m$^2$.

Referring to FIG. 5, the display panel 110 maintains the still image at its initial brightness during a first period t1. Then, if the initial still image continues to be displayed on the display panel 110 during a second period t2, the brightness of that image is gradually reduced during that period. In this case, a reduction rate of the brightness during the second period t2 depends upon the brightness of the initial still image. Particularly, the rate of reduction of the brightness during the second period t2 drops as the brightness of the initial still image is reduced.

Then, the brightness of the still image is maintained during a third period t3. The brightness of the still image is gradually reduced again during a fourth period t4. In this case, the reduction rate of the brightness during the fourth period t4 depends upon the brightness of the initial still image. In particular, the reduction rate of the brightness during the fourth period t4 drops as the initial brightness of the still image is reduced.

Next, the brightness of the still image is maintained during a fifth period t5, and is not reduced anymore.

In the present exemplary embodiment, each of the first to fifth periods t1~t5 has time intervals different from each other. In detail, the time intervals gradually increase from the first period t1 to the fifth period t5.

As described above, in case that the still image is continuously displayed on the display panel 110, the brightness of the still image is gradually reduced, thereby preventing afterimages, improving the lifespan of the organic electroluminescent light emitting device OLED, and reducing power consumption.

Figure 6A:
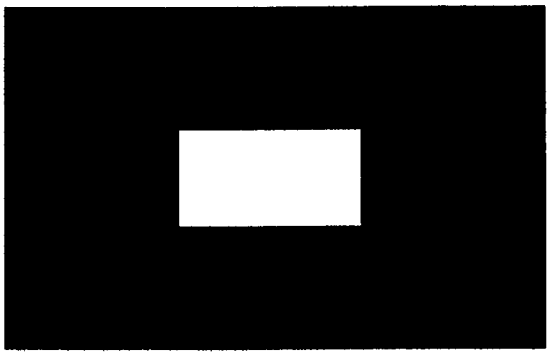
FIGS. 6A to 6C are views showing brightness variation of a display panel.
Figure 6B:
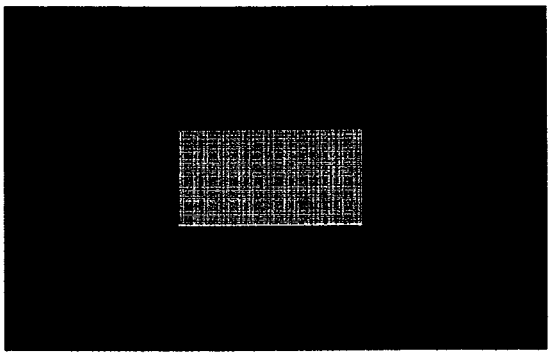
Figure 6C:
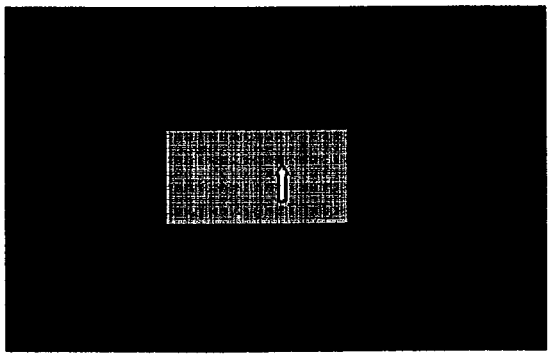

FIG. 6A is a view showing a screen where initial brightness is maintained, FIG. 6B is a view showing a screen after brightness is reduced according to elapsed time, and FIG. 6C is a view showing a screen after an event occurs.

For purposes of explanation, assume that FIG. 6A shows display panel 110 displaying an initial still image at a brightness of about 500 nits. When the still image is continuously displayed on the display panel 110, the brightness of the display panel 110 is reduced to 180 nits over time, as shown in FIG. 6B.

As shown in FIG. 6C, while a still image is displayed, even though a small event occurs to the image displayed (for example, in this case, a mouse pointer is positioned on the screen of the display panel 110), the brightness of the display panel 110 may be maintained at 180 nits.

As shown in FIGS. 3 and 4, the sums of the gray scale values of the local image data corresponding to the blocks B1~B5 located at different positions of the display panel 110 are compared with those of adjacent frames, and the brightness of the display panel 110 is reduced or maintained only when the difference between the sums obtained by comparing adjacent frames is equal to or less than the reference value.

In this case, a mouse pointer is positioned on the screen of the display panel 110, the difference between the sums obtained by comparing adjacent frames may be less than the reference value. Thus, the brightness of the display panel 110 may be maintained at 180 nits, thereby preventing the brightness from increasing unexpectedly when the small event occurs.

Figure 7:
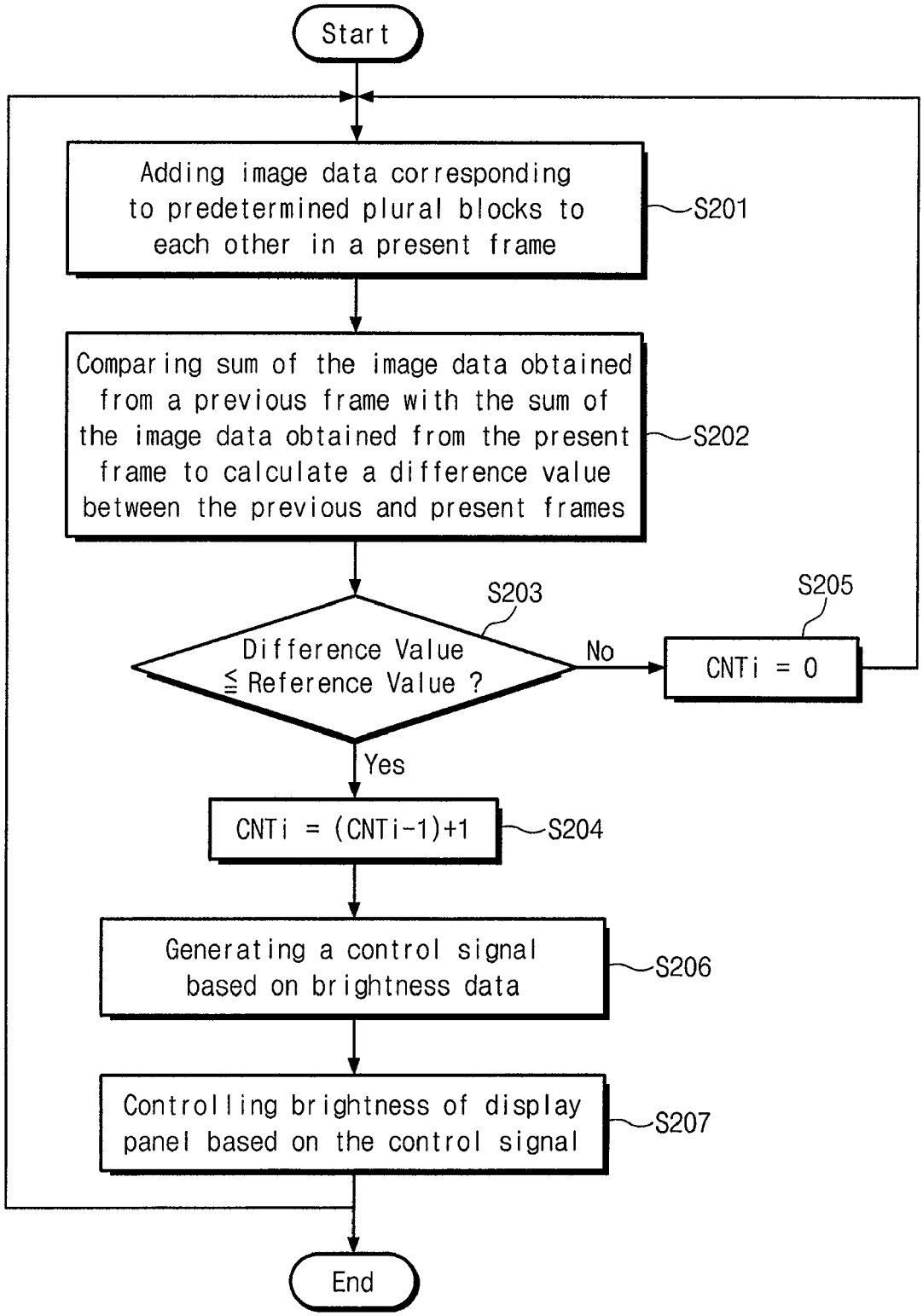
FIG. 7 is a flowchart illustrating a method of driving the organic electroluminescent light emitting display device of FIG. 1.

FIG. 7 is a flowchart illustrating a method of driving the organic electroluminescent light emitting display device of FIG. 1.

Referring to FIG. 7, the local image data corresponding to predetermined plural blocks of the display panel are added to each other (S201). The sum of the gray scale values of the local image data obtained from the previous frame is compared with the sum the gray scale value of the local image data obtained from the present frame to calculate the difference value between the previous frame and the present frame (S202).

Then, this difference value is compared to a predetermined reference value, to find out whether the difference value is equal to or less than the reference value (S203). When the difference value is equal to or less than the reference value, a count value (corresponding to a displaying time of the image displayed on the display panel) increases (S204), and when the difference value is more than the reference value, the count value is reset (S205).

Next, a control signal is generated based on the brightness data corresponding to the count value (S206). The brightness of the display panel is then adjusted based on the control signal (S207).

In the present exemplary embodiment, the brightness of the display panel may be gradually lowered while a still image is displayed on the display panel.

As described above, the brightness of the display panel is adjusted according to the image displayed on the display panel, thereby preventing afterimages, improving the lifespan of the organic electroluminescent light emitting device OLED, and reducing power consumption.

Although the exemplary embodiments of the present invention have been described, it is understood that the present invention should not be limited to these exemplary embodiments but various changes and modifications can be made by one ordinary skilled in the art within the spirit and scope of the present invention as hereinafter claimed.

What is claimed is:

1. A display apparatus comprising:

a display panel that comprises a plurality of gate lines, a plurality of voltage lines, and a plurality of pixels and displays an image;

a timing controller that processes image data, the timing controller comprising:

a panel controller that outputs the image data in synchronization with a first control signal; and a brightness controller that detects a variation from one frame to the next in a sum of gray scale values of the image data (hereinafter, referred to as local image data) corresponding to selected plural regions of the display panel, and outputs a second control signal to control a brightness of the display panel according to a duration at which the variation remains below a predetermined value; and a panel driver that drives the display panel in response to the first control signal and the image data, and controls a brightness of the display panel in response to the second control signal, wherein the panel driver comprises a voltage generator that receives the second control signal from the timing controller and supplies a driving voltage to the voltage lines, and wherein the voltage generator adjusts a voltage level of the driving voltage in response to the second control signal, thereby controlling the brightness of the display panel.

2. The display apparatus of claim 1, wherein the brightness controller further comprises:

a comparator that compares sums of the gray scale values of the local image data from two adjacent frames, and outputs a comparison signal;

a timer that counts a displaying time of the image in response to the comparison signal from the comparator; and a look-up table that stores brightness data according to the displaying time;

wherein the comparator receives the brightness data from the look-up table, the brightness data corresponding to a count value from the timer, to facilitate generation of the second control signal.

3. The display apparatus of claim 2, wherein the comparison signal has a first state when a difference between the sums of the gray scale values of the local image data is equal to or less than a predetermined reference value, and has a second state when the difference is greater than the reference value.

4. The display apparatus of claim 3, wherein the timer increases the count value when the comparison signal has the first state, and resets the count value when the comparison signal has the second state.

5. The display apparatus of claim 2, wherein the brightness of the display panel is gradually reduced over the displaying time.

6. The display apparatus of claim 2, wherein the brightness controller further comprises a memory that stores the sums of the gray scale values of the local image data.

7. The display apparatus of claim 1, wherein the display panel is divided into a plurality of blocks each of which includes a plurality of pixels, and the brightness controller calculates a sum of the gray scale values of the local image data supplied to each block.

8. The display apparatus of claim 7, wherein the blocks are positioned at a center portion, a left upper portion, a left lower portion, a right upper portion, and a right lower portion of the display panel, respectively.

9. The display apparatus of claim 1, wherein the panel driver further comprises a gate driver that sequentially outputs a gate voltage to the gate lines and a data driver that outputs a data voltage to the data lines.

10. The display apparatus of claim 9, wherein each pixel comprises:

a switching transistor connected to a corresponding gate line and a corresponding data line to output a corresponding data voltage in response to the gate voltage;

a driving transistor that controls an amount of a current therefrom in response to the data voltage output from the switching transistor;

an image maintaining capacitor connected between the corresponding data line and a corresponding voltage line and charged by a voltage difference between the corresponding data voltage and the corresponding driving voltage to maintain the driving transistor in an on state; and an organic electroluminescent light emitting device that emits a light in response to the current output from the driving transistor.

11. A method of driving a display apparatus, comprising:

adding gray scale values of image data corresponding to selected plural positions of the display panel for a plurality of frames, so as to determine sums of the gray scale values of the image data for each frame of the plurality of frames;

comparing a sum of the image data obtained from a previous frame with a sum of the gray scale values of the image data obtained from a present frame to calculate a difference value between the previous frame and the present frame;

comparing the difference value with a predetermined reference value;

increasing a count value when the difference value is equal to or less than the reference value, and resetting the count value when the difference value is greater than the reference value, wherein the count value corresponds to a displaying time of an image displayed on a display panel;

repeating the adding, the comparing a sum of the image data, the comparing the difference value, and the increasing in order for plural successive frames;

generating a control signal based on brightness data corresponding to the count value; and controlling a voltage level of a driving voltage supplied to the display panel based on the control signal so as to determine the brightness according to the count value.

12. The method of claim 11, wherein the brightness of the display panel is reduced over the displaying time.

* * * * *